US006168374B1

(12) United States Patent
Stolle et al.

(10) Patent No.: US 6,168,374 B1
(45) Date of Patent: Jan. 2, 2001

(54) FRICTION VACUUM PUMP

(75) Inventors: Robert Stolle; Heinz-Dieter Odendahl; Christian Beyer, all of Cologne (DE)

(73) Assignee: Leybold Vakuum GmbH, Cologne (DE)

( * ) Notice: Under 35 U.S.C. 154(b), the term of this patent shall be extended for 0 days.

(21) Appl. No.: 09/242,004

(22) PCT Filed: Jul. 2, 1997

(86) PCT No.: PCT/EP97/03477

§ 371 Date: Feb. 5, 1999

§ 102(e) Date: Feb. 5, 1999

(87) PCT Pub. No.: WO98/07989

PCT Pub. Date: Feb. 26, 1998

(30) Foreign Application Priority Data

Aug. 16, 1996 (DE) ..... 196 32 874

(51) Int. Cl.[7] ..... F01D 1/36

(52) U.S. Cl. ..... 415/90; 415/143; 415/199.4

(58) Field of Search ..... 415/90, 72, 73, 415/74, 143, 199.4, 199.5; 416/176, 177

(56) References Cited

U.S. PATENT DOCUMENTS 3,947,193 3/1976 Maurice .
4,684,317 8/1987 Luijten et al. .
4,708,586 11/1987 Sawada et al. .
4,732,529 * 3/1988 Narita et al. ..... 415/90
4,797,062 1/1989 Deters et al. .
5,051,060 9/1991 Fleischmann et al. .
5,217,346 * 6/1993 Ikegami et al. ..... 415/55.1
5,238,362 * 8/1993 Casaro et al. ..... 415/90
5,553,998 * 9/1996 Muhlhoff et al. ..... 415/90
5,695,316 * 12/1997 Schutz et al. ..... 415/90

FOREIGN PATENT DOCUMENTS

2629877 * 10/1989 (FR) .
2232205 11/1991 (GB) .

* cited by examiner

*Primary Examiner*—Edward K. Look
*Assistant Examiner*—James M. McAleenan
(74) *Attorney, Agent, or Firm*—Wall Marjama & Bilinsk

(57) ABSTRACT

The present invention relates to a friction vacuum pump having at least one turbomolecular pump stage (2) joined at its pressure side to a screw pump stage (4). In order to improve the pump properties it is proposed that a filling stage (3) be arranged between the turbomolecular pump stage (2) and the screw pump stage (4) that has blades (13) whose length corresponds at the suction side to the active length of the blades at the pressure side of the turbomolecular pump stage (2), and at the pressure side to the depth of the suction-side region of the screw (14) of the screw stage (4).

13 Claims, 3 Drawing Sheets

FRICTION VACUUM PUMP

BACKGROUND OF THE INVENTION

The present invention relates to a friction vacuum pump having at least one turbomolecular pump stage joined at its pressure side to a screw pump stage.

It is known to increase the forevacuum tolerance of turbomolecular pumps by arranging, downstream of its turbomolecular stages, a screw stage. The problem of effectively utilising the screw pump stage is, that an effective pumping performance at the inlet of the screw (suction side of the screw) independent of the pressure as far as possible, can not be ensured. The reason for this is, that the flow characteristic of the pumped gases in the transition region between turbomolecular pump stages and screw pump stages changes from the molecular type (at pressures below 10−3 mbar) to the laminar type (from about 10−2 mbar and above). Known designs of the transition region between the turbomolecular pump stages and the screw pump stages have the disadvantage of the flow breaking away. This will considerably impair the pumping performance of the pump.

From DE-A-36 27 642 (claim 4) a friction pump of the kind affected here is known. The turbomolecular stage is followed by a downstream screw pump stage. The inlet of the screw pump stage has not been designed in any special manner. The depth of the screw does not change across the length of the screw pump stage.

SUMMARY OF THE INVENTION

It is the task of the present invention to improve the pumping performance of a friction pump of the aforementioned kind by an improvement to the inlet region of the screw pump stage.

This task is solved through the present invention by the characteristic features of the patent claims.

The measures according to the present invention have the effect that the transition region between the turbomolecular pump stage and the screw pump stage is geometrically adapted to match the type of flow. The flow which changes in this transition region from a molecular flow to a laminar flow is only impaired to an insignificant extent. The flow will not breakaway. The properties of the filling stage are adapted to mass flow, implemented degree of compression and absolute pressure.

In one of the advantageous designs, several or all blades of the filling stage are designed as blade-like shaped end sections of the ridges of the screw stage. This simplifies the manufacture of both filling and screw stage.

BRIEF DESCRIPTION OF THE DRAWINGS

Further advantages and details of the present invention shall be explained by reference to the design examples presented in drawing FIGS. 1 to 6. Depicted in drawing

drawing

drawing

DESCRIPTION OF THE INVENTION

Figure 1:
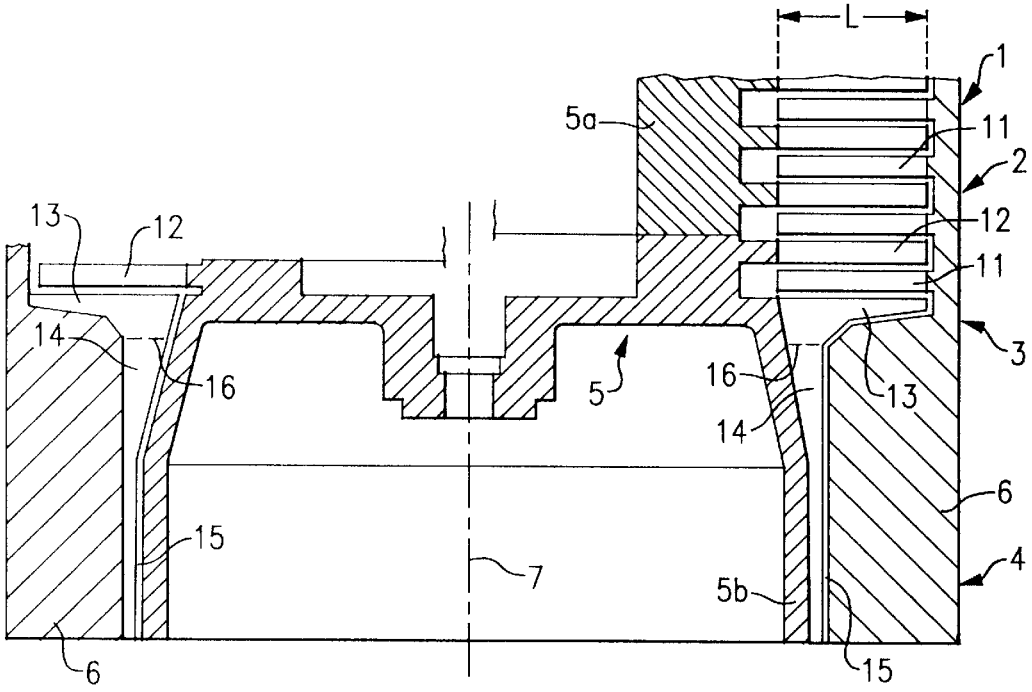
FIGS. 1 and 2 are partial sections through a pump designed according to the present invention with, in all, four design variations for the screw pump stage and the filling stage.
Figure 2:
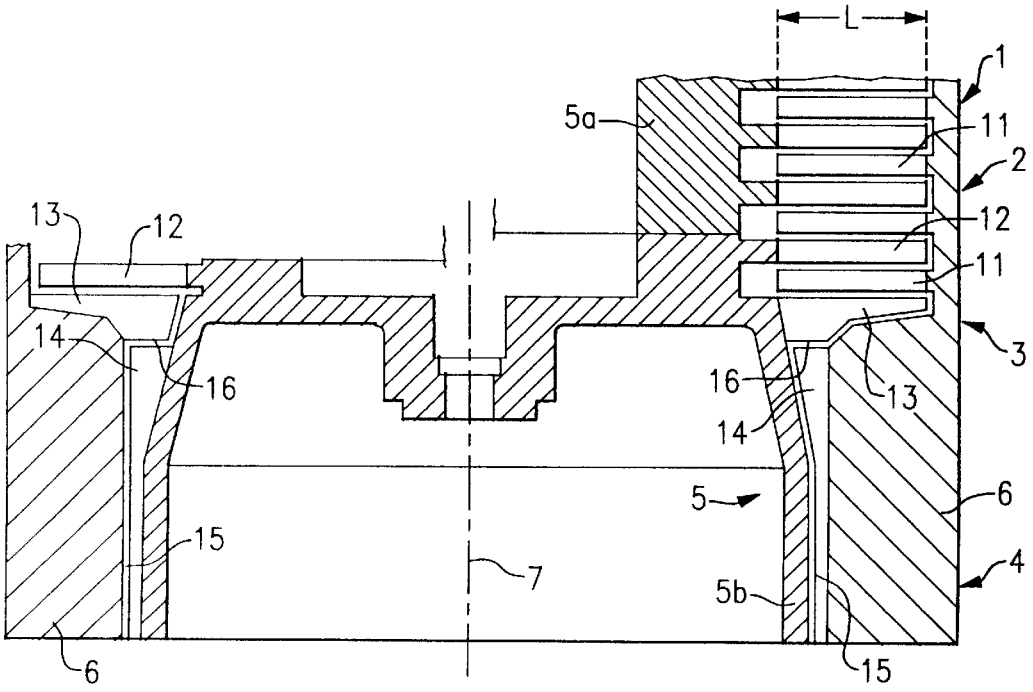

Drawing FIGS. 1 and 2 show that the pump 1 according to the present invention comprises a turbomolecular pump stage 2, a filling stage 3 and a screw pump stage 4. The gas is pumped between a rotor 5 (rotor sections 5*a* and 5*b*) and a stator 6. The axis of rotation is designated as 7. Rotor 5 and/or stator 6 carry the structures effecting the gas pumping action.

Components of turbomolecular pump stage 2 are the rows of stator blades 11 and the rows of rotor blades 12. The filling stage 3 comprises several blades 13. Screw 14 is characteristic for the screw stage 4.

Depicted in drawing FIGS. 1 and 2 are in all four variants with respect to the design of the filling stage 3 and the screw pump stage 4:

Drawing FIG. 1, left: blades 13 and screw 14 part of the stator 6.

Drawing FIG. 1, right: blades 13 and screw 14 part of the rotor 5.

Drawing FIG. 2, left: blades 13 of the stator 6, screw 14 part of rotor 5.

Drawing FIG. 2, right: blades 13 of the rotor 5, screw 14 part of stator 6.

It is not necessary to assign a blade 13 to each ridge of the screw 14. Depending on the application, fewer or more blades 13 than screw ridges 14*a* may be present. Located between rotor 5 and stator 6 is the slot 15 which should be as small as possible and which commonly is less than one millimeter.

Figure 3:
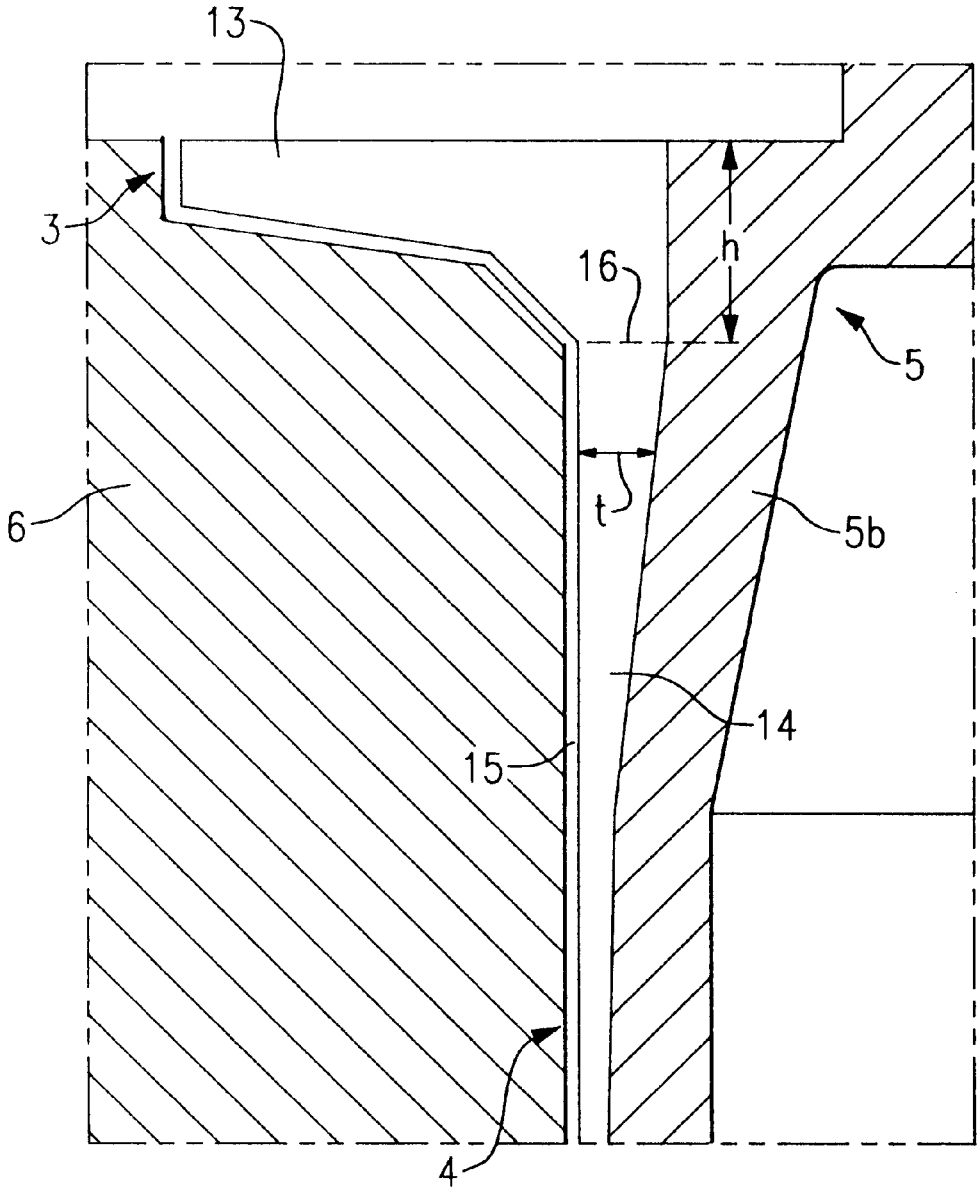
FIG. 3 is an enlarged variant according to drawing FIG. 1, right, where a screw ridge of the screw pump stage transforms into a blade of the filling stage.

In particular from drawing FIG. 3 (enlarged presentation of the design according to drawing FIG. 1, right) it may be determined how the blades 13 are designed. In this design there are blade-shaped end sections of screw 14 being characterized practically by a strong increase in the screw's depth t. This increase commences at the level of the dashed line 16 and extends across a relatively short section, designated as h, of the rotor 5.

The depth of the screw t increases in the direction of the suction side to an extent which approximately corresponds to the active length of the blades of the row of stator blades 11 on the suction side, or the row of rotor blades 12 of turbomolecular pump stage 2. This strong increase in the screw's depth t is preferably designed to extend across the section h of the rotor 5, this section being less than the length of the blades on the suction side of turbomolecular pump 2, preferably even less than half of the length 1 of these blades. In this region, the depth t of the screw increases by the factor of 4 to 8, preferably about 6. In the direction of the pressure side, the depth t of the screw reduces further, however—as previously common—relatively gradually. The angle of incidence for blades 13 is between the angle of incidence for the neighbouring blades of the turbomolecular pump stage 2, and the angle of the neighboring ridges 14*a* of the screw (ridge angle $\alpha$).

In the design where the blades 13 rotate (drawing FIGS. 1 and 2, right), there is located in the mounted state a row of stator blades 11 immediately above the blades 13. The row of rotor blades 12 of turbomolecular pump stage 2 located directly above may also be affixed to rotor 5*b* of the filling and screw pump stage 3, 4, this being particularly apparent in drawing FIGS. 4 to 6.

In the designs where the blades 13 rest (drawing FIGS. 1 and 2, left) a row of rotor blades with its blades 12 is located immediately above the resting blades 13. Also in this design the row of blades 12 is affixed to rotor 5*b* of the filling and screw stage 3, 4.

Figure 4:
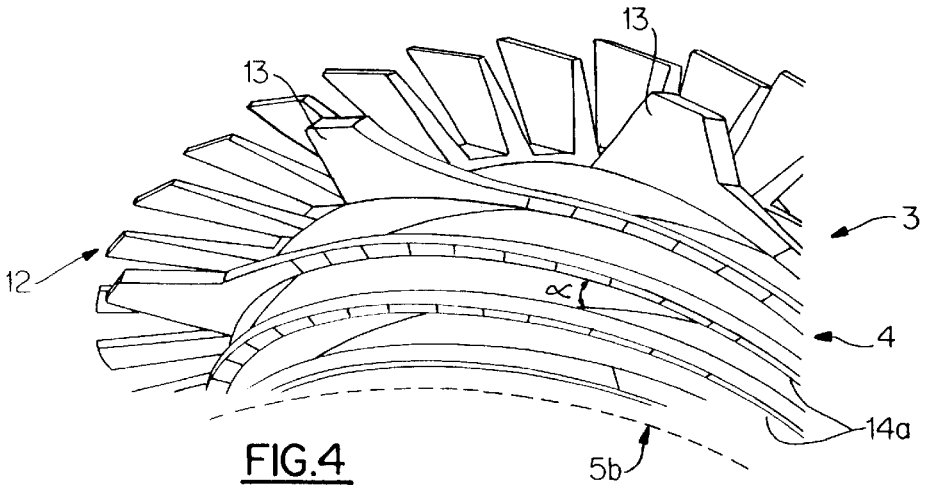
FIGS. 4 to 6 are partial views of the transition region between turbomolecular pump stage and screw pump stage presenting rotors designed according to the present invention.
Figure 5:
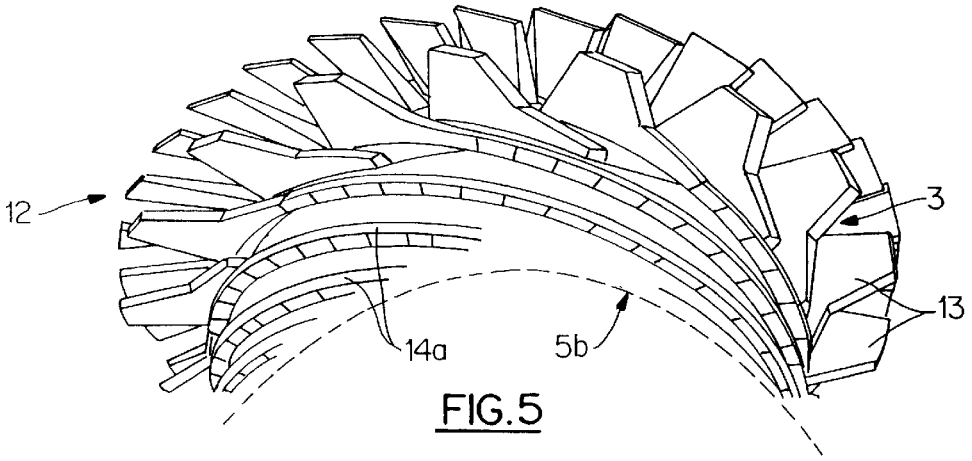
Figure 6:
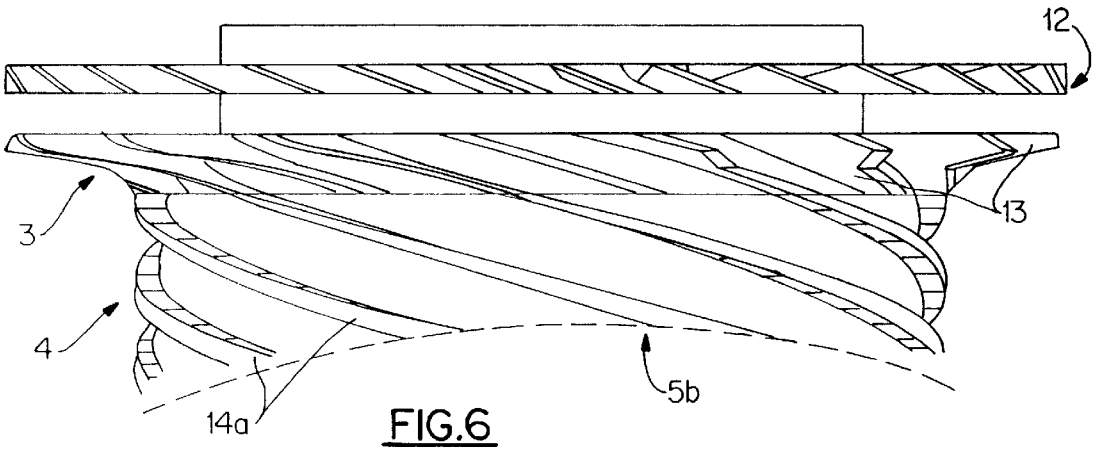

From drawing FIGS. 4 to 6 it can be determined, that the screw pump stage 4 has several screw ridges 14*a,* for example between four to sixteen, preferably eight. The ridge angle α (with respect to the horizontal) amounts to between about 10° and 20°. Moreover, the blades 12 of the last row of blades on the pressure side of turbomolecular pump stage 2 are depicted, which—as described for the drawing FIGS. 1 to 3—are also affixed at the rotor section 5*b* of the filling stage 3 and the screw stage 4. The number of blades 12 exceeds the number of blades 13 by about a factor of 1.5 to 5, preferably 4.

In the designs according to drawing FIGS. 5 and 6, the number of blades 13 is greater than the number of screw ridges 14*a.* Located on the suction side between each end section 13 of the screw ridges 14*a,* said end sections being designed as a blade, is a further blade 13.

What is claimed is:

1. A friction vacuum pump that includes:

at least one turbomolecular pump stage having a pressure side and a suction side and containing turbomolecular blades;

a screw pump stage having a pressure side and a suction side and containing screw ridges;

a filling stage having a suction side and a pressure side mounted between the turbomolecular pump stage and the screw pump stage so that the suction side of the filling stage is adjacent the pressure side of the turbomolecular pump stage and the pressure side of the filling stage is adjacent the suction side of the screw pump stage; and said filling stage having blades on its suction side that are about equal in length to the turbomolecular blades on the pressure side of the turbomolecular pump stage and a length on its pressure side that is about equal to the depth of the screw ridges on the suction side of the screw pump stage.

2. The friction pump of claim 1 such that screw ridges are blade shaped elements that are related in substantially fixed proportion to the shape of the filling stage blades on the pressure side of the filling stage.

3. The friction pump of claim 1 wherein the filling stage blades have an angle of incidence that is between the angle of incidence of the turbomolecular blades on the suction side of the turbomolecular pump stage and the angle of incidence of the screw ridges on the pressure side of the screw pump stage.

4. The friction pump of claim 3 wherein said screw pump stage has a plurality of screw ridges having an angle of incidence between 10° and 20°.

5. The friction pump of claim 4 wherein said screw pump stage contains between four and sixteen screw ridges.

6. The friction pump of claim 5 wherein said screw pump stage contains eight screw ridges.

7. The friction pump of claim 5 wherein the number of filling stage blades is greater than that of the screw ridges.

8. The friction pump of claim 1 wherein the number of turbomolecular blades on the pressure side of the turbomolecular pump stage exceed the number of filling stage blades by a factor of between 1.5 and 5.0.

9. The friction pump of claim 1 wherein the number of turbomolecular blades on the pressure side of the turbomolecular pump stage are four times greater than the number of filling stage blades.

10. The friction pump of claim 1 wherein the filling stage blades have height that is greater than the depth of the screw ridges at the suction side of the screw pump.

11. The friction pump of claim 10 wherein the height of the filling stage blades is about half the length of said filling stage blades.

12. The friction pump of claim 1 wherein the screw pump stage contains a rotor that is separate from the filling stage rotor.

13. The friction pump of claim 12 wherein the rotor of the screw pump stage also contains at least one row of turbomolecular blades.

* * * * *